United States Patent [19]

Edwards et al.

[11] Patent Number: 4,643,670

[45] **Date of Patent: * Feb. 17, 1987**

[54] BURNER

[75] Inventors: David M. Edwards, Wokingham; Kenneth H. Haywood, Wootton Bridge, both of England

[73] Assignee: The British Petroleum Company p.l.c., London, England

[ * ] Notice: The portion of the term of this patent subsequent to Jan. 15, 2001 has been disclaimed.

[21] Appl. No.: 632,248

[22] Filed: Jul. 19, 1984

[30] Foreign Application Priority Data

Jul. 20, 1983 [GB] United Kingdom ..... 8319620

[51] Int. Cl.[4] ..... F23D 13/20

[52] U.S. Cl. ..... 431/202; 431/171; 431/347; 431/350; 431/354; 239/498; 239/502; 239/522

[58] Field of Search ..... 431/202, 171, 252, 346, 431/347, 348, 349, 350, 354; 239/288.3, 498, 502, 521, 522, 524

[56] References Cited

U.S. PATENT DOCUMENTS

| | | | |
|---|---|---|---|
| 1,103,253 | 7/1914 | Bennett | 431/350 X |
| 2,409,421 | 10/1946 | Dufault | 431/350 |
| 3,051,464 | 8/1962 | Yeo et al. | 431/347 X |
| 3,302,687 | 2/1967 | Gjerde | 431/350 X |
| 3,933,420 | 1/1976 | Zink et al. | 431/202 |
| 4,245,979 | 1/1981 | Ito | 431/202 |
| 4,493,638 | 1/1985 | Scammell | 431/171 X |

*Primary Examiner*—Randall L. Green

*Attorney, Agent, or Firm*—Morgan, & Finnegan

[57] ABSTRACT

A burner suitable for use in a ground flare has a fuel gas supply pipe shaped to have a low resistance to upward air flow. The fuel gas supply pipe has one or more outlets in its upper surface which direct fuel gas onto adjacent plates to cause spreading and mixing of the fuel gas with aspirated air. The plates have a top edge adapted to give flame retention. The central portion of the upper edge of the plate is inclined into a substantially horizontal position towards the fuel gas outlet and the outer portions of the plate are inclined in the direction away from the fuel gas outlet.

11 Claims, 8 Drawing Figures

BURNER

The present invention relates to burners and more particularly to burners used for the disposal of refinery gases or gases from other oil, gas or chemical plant.

Conventional refinery burners comprising a fuel gas feed tube having a number of outlet holes are well known. These burners are of simple construction and relatively straightforward to fabricate. However, they produce relatively long radiative flames with a relatively high smoking tendency caused by relatively poor aerodynamics. Also carbon build up in the feeder tube caused by back radiation and flame lick can cause the feeder tube to split, thereby reducing the burner efficiency or even disabling it until repairs can be effected.

The burners are often used as part of a ground flare. A problem with ground flares is that the chimney requires a refractory or insulating lining to prevent the outer metal wall from becoming too hot. Highly radiative flames give rise to high temperatures and high thermal stresses in the refractory materials which can cause cracking and even eventual failure of the refractory.

European Patent Application No. 0062402 describes a burner suitable for use in a ground flare. The present invention relates to an improved burner which is also suitable for use in a ground flare.

Thus according to the present invention there is provided a burner comprising a fuel gas supply pipe having a low resistance to upward air flow, the pipe having one or more outlets, means for passing air upwardly past the outlets, a plate adjacent to and at an angle to the outlet so that fuel gas emerging from the outlet spreads over the surface of the plate and mixes with the upward air flow and means for retaining the flame resulting from the combustion of the fuel gas and air, the flame retaining means comprising the central portion of the upper edge of the plate being inclined into a substantially horizontal position towards the free gas outlet and the outer portions of the upper edge of the plate being inclined in the direction away from the fuel gas outlet.

Preferably the plate is adjacent and at an angle to the outlet whereby the angle of the fuel-gas impingement on the plate is at an angle 1° to 55°.

The plate has associated flame retention means in which the central portion of the upper edge of the plate is turned over in the direction of the fuel gas outlet, the outer portion of the upper edge being turned over in the opposite direction. The flame retention means reduces the tendency of the flame to lift off by providing a turbulent "anchor" zone of fuel gas and air. The plate itself is preferably flat and is of a size to cause spreading and mixing of the fuel gas with air. The plates are preferably fabricated from stainless steel. The plate allows the fuel gas to spread out as a thin layer across the plate and in combination with the flame retention means gives a stable flame remote from the fuel gas outlets thereby reducing heating of and carbon build-up in the fuel gas supply pipes. The carbon build-up is believed to be caused not by deposition from the flame but by excessively high temperatures of the fuel gas supply tubes giving rise to pyrolysis of the fuel gas.

Preferably the plates are arranged in a regular parallel array. The regular parallel array of the plates have been found to give an improved flame configuration which is relatively flat across the burner and is also relatively short and less radiative.

The outlets are on the downstream side of the fuel gas supply line relative to the upward air flow. Preferably the plane of the plates is at right angles to the line connecting the fuel gas outlets.

A burner module may be formed from a plurality of burners, the burners being connected by suitable manifolding.

The burner preferably has a chimney or the like above it so as to produce a flow of aspirated air from below the burner to mix with the fuel gas. Alternatively, air may be blown through the burner, e.g. using a fan.

The fuel gas pipes have a cross-section giving low aerodynamic resistance in the direction of air flow which gives rise to improved fuel/air ratios. Preferably this is achieved by use of smooth pipes of greater dimension in the direction of the air flow, e.g. of elliptical section. This is in contrast to typical refinery burners comprising a circular cross-section pipe with fuel gas outlet holes in its upper surface which provides a bluff shape with high resistance to air flow leading to relatively poor performance.

In a preferred embodiment of the invention, the plate of the burner has an aperture adjacent to the fuel outlet. The aperture has been found to improve the flame stability at low fuel gas throughputs and reignition in case of flame blow out.

The fuel outlet may be circular in shape, but preferably it is shaped so as to assist spreading the fuel gas over the plate and an elliptical outlet is a preferred configuration.

The plate is preferably fixed to the upper surface of the gas supply pipe, for example by a bracket or by welding.

In a burner comprising a plurality of fuel gas outlet holes and plates, the plates are preferably discrete entities but may be a single long plate across the burner or a linked series of single plates. By use of discrete or single plates, ignition of the burner may be facilitated as turbulence at the upper ends of the edges of the plates tends to promote cross lighting across the burner.

A radiant heat screen, preferably in the form of a triangular cross-section strip of metal, may be positioned above the common fuel supply pipe so as to prevent overheating due to gas recirculation and direct flame impingement.

The burner as hereinbefore described may be used as part of a ground flare system. Thus, according to a further aspect of the invention, there is provided a ground flare comprising a supply pipe for fuel gas, the supply pipe being connected to a burner as hereinbefore described, and an enclosure having vertical walls, the lower ends of which are above ground level thereby allowing access of air to the burner within the enclosure.

The internal walls of the flare are preferably metallic and lined with a refractory material, e.g. firebricks, castable or plastic refractory material, ceramic fibre. Preferably a draught or wind fence encloses the base of the flare. The draught fence may be slatted so that air can flow through the fence and then into the flare.

The invention also includes a ground flare comprising a plurality of burner as hereinbefore described. In a preferred embodiment of ground flare, the burners arranged having their longitudinal axes substantially at right angles to each other. It has been found that this orientation helps to reduce chimney resonances and pulsations occurring at audio frequencies. The preferred ratio of burner cross sectional area to chimney cross section area is up to 0.5.

The flare may be lit using conventional ignition procedures.

The invention will now be described by way of example only with reference to FIGS. 1 to 5 of the accompanying drawings.

Figure 1:
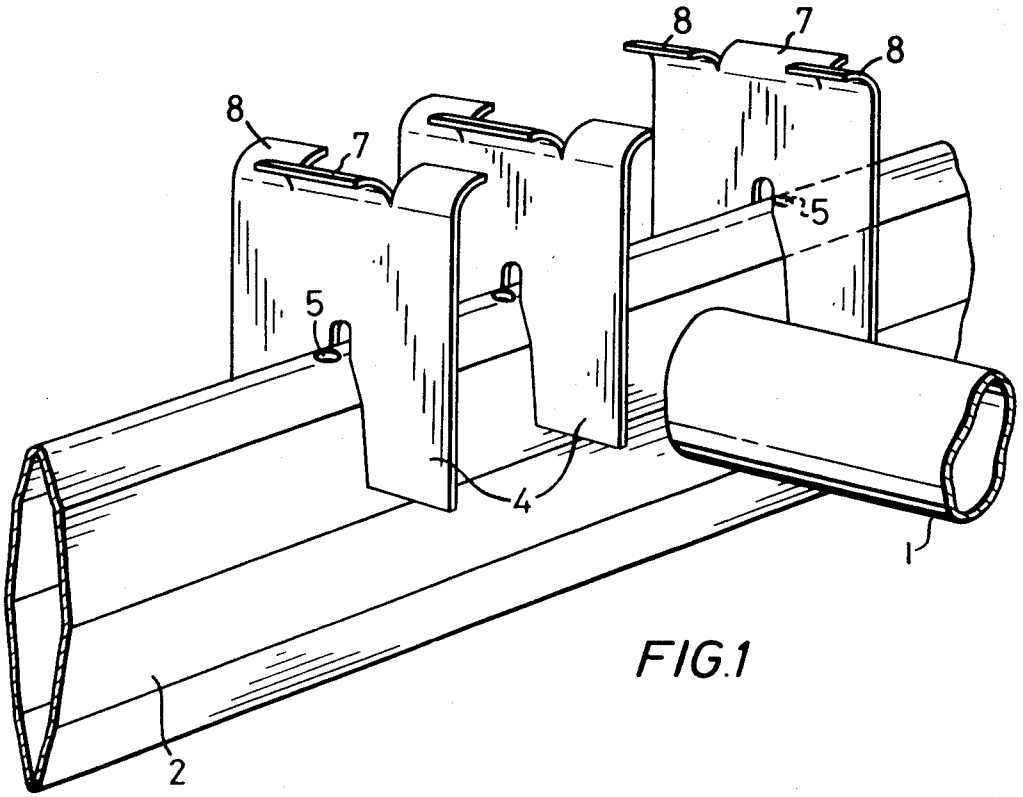
FIG. 1 is a perspective drawing of a portion of a burner according to the invention.
Figures 2A, 2B, 2C:
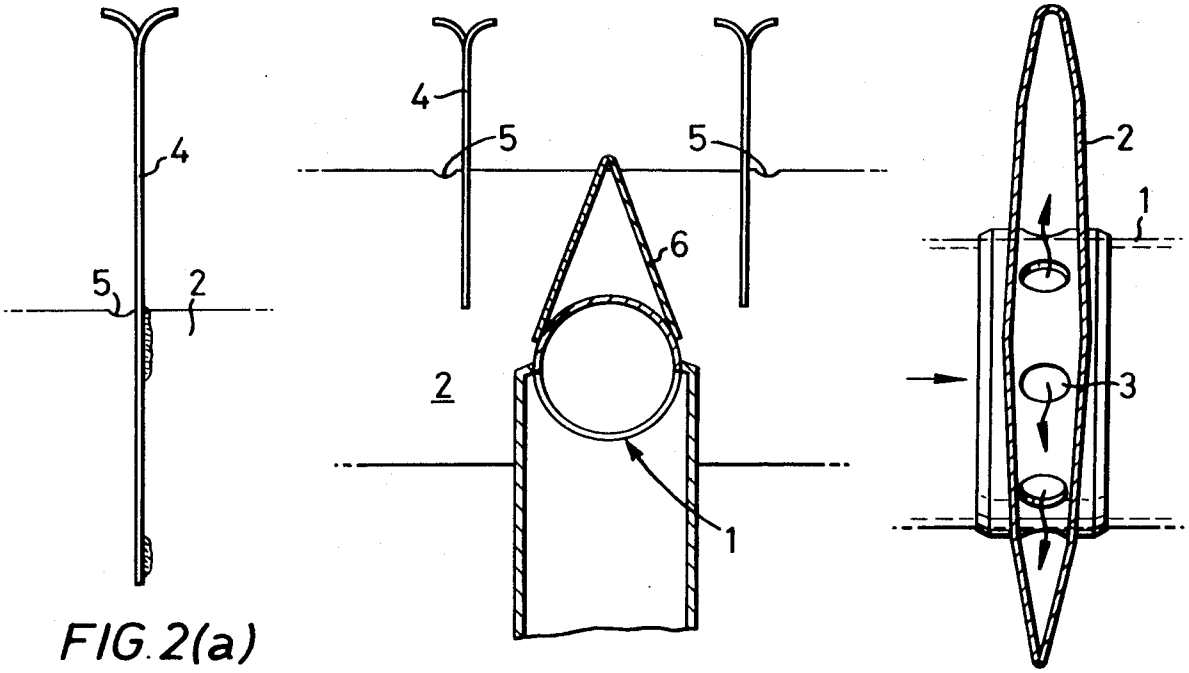
FIG. 2(*a*) is a side view of the plate and fuel outlet of the burner, FIG. 2(*b*) is a partial vertical section of the fuel gas line and associated heat screen of the burner element and FIG. 2(*c*) is a section through a secondary fuel gas line of the burner.

With reference to the FIGS. 1 and 2, the burner comprises a main fuel gas line 1 which feeds a plurality of parallel secondary fuel gas lines 2. The gas line 1 is linked to the secondary line 2 by means of a sleeve which connects the interior of the line 1 to that of line 2 by means of holes 3. At regular intervals along line 2, plates 4 are fixed by welding or other suitable means. The plates 4 are at right angles to the axis of the line 2. A hole or aperture in the plate adjacent to the fuel outlet assists flame stability at low fuel gas throughputs. Fuel outlet holes 5 in the lines 2 lie adjacent to the base of the plates 4. The outlet holes 5 are cut so as to direct at least a part of the fuel gas onto the surface of the plate 4. The cross-section of the outlet holes was circular or elliptical. FIG. 2(*b*) shows a radiant heat screen 6 of triangular cross-section which serves to protect the gas line 1 from direct flame impingement and recirculation of hot gases.

During use of the burner, at least part of the fuel gas emerging from outlet holes 5 impinges on plates 4 and spreads over the surface of the plates 4. This allows mixing of air and the fuel gas to provide a combustible mixture.

The plate 4 has its central upper edge 7 bent over to create a lip to prevent lift off of the flame and acts as a flame retainer. The top edge of the plate used in the experiments was bent over to an angle of up to 90°. The two outer upper edges 8 of the plate 4 are bent back in the opposite direction to the central upper edge to create a pair of wings which further assist fuel gas/air mixing and flame stability.

The upward flow of air past the outlet holes and plates was achieved by placing an enclosure or chimney around the burner so as to aspirate air upwardly through the burner. An alternative method of achieving this effect would be to use a fan or blower to force air upwardly through the burner.

Figure 3:
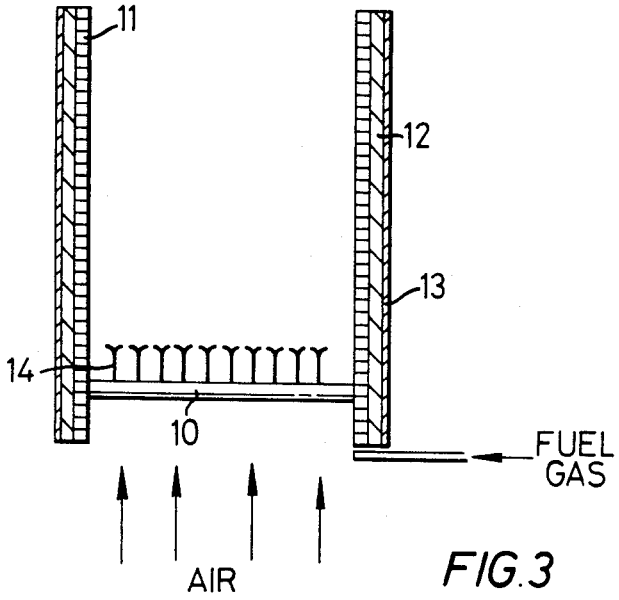
FIG. 3 is a vertical section of a ground flare comprising a burner.

FIG. 3 shows a vertical cross-section of a ground fired flare having a burner according to the invention. The burner 10 is positioned at the base of the flare chimney. The chimney comprises an inner refractory material 11, an insulating centre portion 12 and an outer metal skin 13. During operation of the flare, fuel gas is mixed with aspirated air from the chimney draught to produce, after ignition of the combustible mixture, flames stabilising above the plates 14 of the burner 10.

Figure 4A:
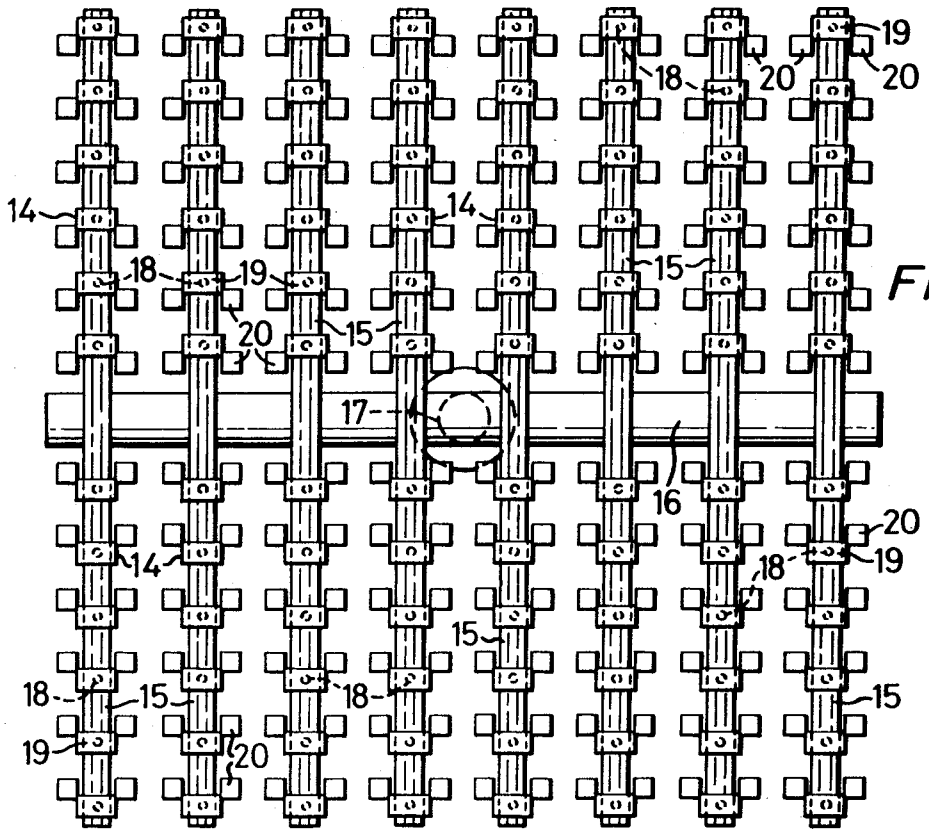
FIG. 4(*a*) is a plan view of a 2×8 armed burner element, each arm carrying 12 plates and FIG. 4(*b*) is a side view with partial vertical section of the burner of FIG. 4(*a*).
Figure 4B:
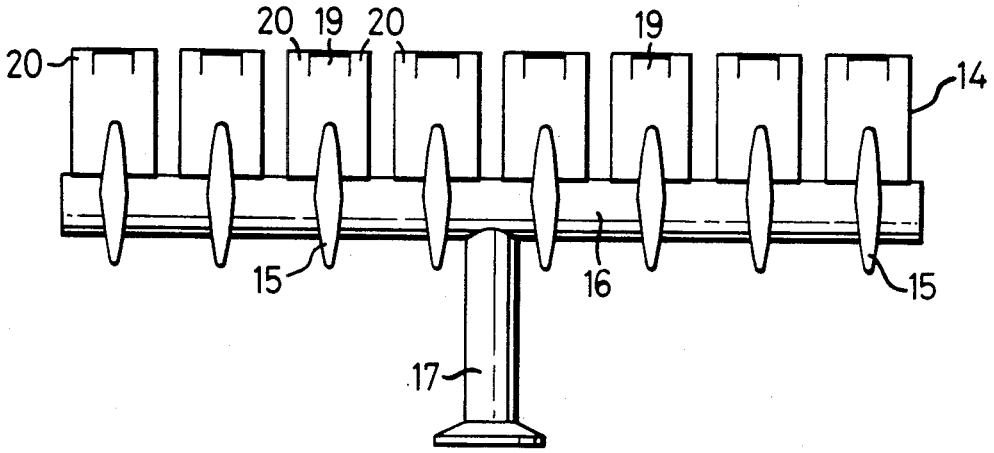

In FIG. 4, a single burner has eight arms 15 projecting from each side of a central manifold 16, the manifold 16 being supplied with fuel gas from a vertical pipe 17. Each arm 15 carries twelve fuel outlets 18 and associated plates 14, each plate 14 having a central bent over flame retaining upper edge 19 and wings 20 on either side bent over in the opposite direction. The radiant heat screen has been omitted from the drawings for reasons of clarity.

Figure 5:
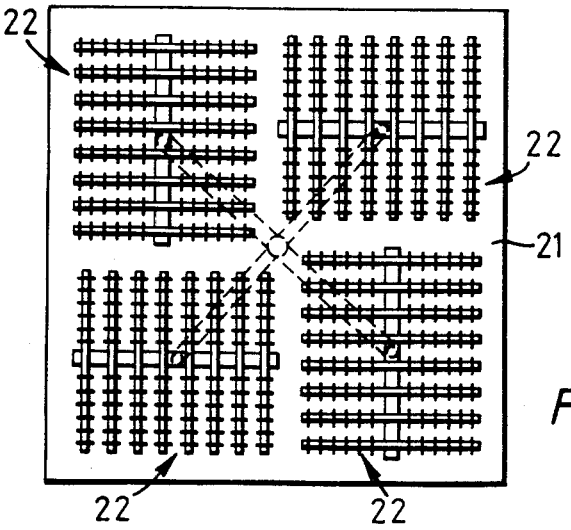
FIG. 5 is a plan view of a ground flare showing the arrangement of burners.

In FIG. 5, a ground flare 21 is shown which comprises four burners 21. Each burner is as shown in FIG. 4 and each is fed from a vertical fuel supply pipe. Each burner is oriented so that its longitudinal axis is at right angles to that of its neighbour. Also each burner has its plates oriented so that they face (i.e. the central portion is bent over) away from the central manifold.

We claim:

1. A burner comprising a fuel gas supply pipe having a low resistance to upward air flow, the pipe having at least two outlet means for passing gas upwardly through the outlets, a plate adjacent to and above the outlet so that fuel gas emerging from the outlet spreads over the surface of the plate and mixes with the upward air flow and means formed by the plate for retaining the flame resulting from the combustion of the fuel gas and air, the flame retaining means comprising a central portion of the upper edge of the plate being inclined towards an associated outlet adjacent to the plate and the outer portions of the upper edge of the plate being inclined away from the outlet adjacent to the plate and towards a further outlet adjacent to a neighboring plate, such that said central portion of one plate and the outer portions of an adjacent plate are directed towards one another for providing turbulent mixing of the air and gas.

2. A burner according to claim 1 in which the plates are arranged in a regular parallel array.

3. A burner according to claim 2 comprising a plurality of fuel gas supply pipes, the plane of the plates being substantially perpendicular to the longitudinal axes of the supply pipes.

4. A burner according to claim 2 in which a regular parallel array of single plates extend across and at right angles to the fuel gas supply pipes.

5. A burner according to claim 1 in which the fuel outlet is elliptical in shape.

6. A burner according to claim 1 in which a radiant heat screen is positioned above the fuel supply pipe.

7. A ground flare comprising a supply pipe for fuel gas, the supply pipe being connected to a burner according to claim 12.

8. A ground flare according to claim 7 in which a plurality of burners are arranged having their longitudinal axes substantially mutually at right angles to each other.

9. A ground flare according to claim 8 having fair sets of burners arranged in a square, each set of burners being fed from a vertical supply pipe, each set of burners being so oriented that the longitudinal axis of one set of burners is at right angles to that of the longitudinal axis of the neighboring set of burners, the burners of each set having its plates oriented so that they face away from a central manifold.

10. A ground flare according to any of claims 7 or 8 having an enclosure with vertical walls, the lower ends of the walls being above ground level to thereby allow access of air to the burner within the enclosure.

11. A ground flare according to claims 7 or 8 having a wind fence enclosing the base of the flare.

* * * * *